US006237518B1

(12) United States Patent
Yunoki et al.

(10) Patent No.: US 6,237,518 B1
(45) Date of Patent: May 29, 2001

(54) TROUSERS-FLY-SERGING APPARATUS

(75) Inventors: Akio Yunoki; Yukio Maede; Osamu Igarashi, all of Toyama-ken (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 09/373,473

(22) Filed: Aug. 12, 1999

(30) Foreign Application Priority Data

Aug. 31, 1998 (JP) ..... 10-284706

(51) Int. Cl.[7] ..... D05B 35/06
(52) U.S. Cl. ..... 112/470.33; 112/308
(58) Field of Search ..... 112/470.33, 470.12, 112/470.13, 470.18, 470.28, 122.3, 129, 304, 306, 308, 320

(56) References Cited

U.S. PATENT DOCUMENTS

| | | | | |
|---|---|---|---|---|
| 4,181,085 | * | 1/1980 | Conner, Jr. | 112/308 X |
| 4,362,116 | * | 12/1982 | Sen Gupta et al. | 112/113 X |
| 5,161,474 | | 11/1992 | Ishikawa et al. . | |
| 5,170,733 | * | 12/1992 | Homma et al. | 112/308 |

FOREIGN PATENT DOCUMENTS

| | | | | |
|---|---|---|---|---|
| 0 476 488 | | 3/1992 | (EP) . | |
| 1 384 073 | | 2/1975 | (GB) . | |
| 1 543 780 | | 4/1979 | (GB) . | |
| 1 577 086 | | 10/1980 | (GB) . | |
| 6091075 | * | 4/1994 | (JP) | 112/308 |
| WO 91/05898 | | 5/1991 | (WO) . | |

* cited by examiner

*Primary Examiner*—Ismael Izaguirre
(74) *Attorney, Agent, or Firm*—Finnegan, Henderson, Farabow, Garrett & Dunner, L.L.P.

(57) ABSTRACT

In a trousers-fly-serging apparatus, a fly is fed on and along a feed table by a retaining portion of a linear supply section, and pressing levers attached to lower portions of four corners of a support body move down to press and retain the fed fly with tip ends of the pressing levers. Then, a rod actuated by a pressure cylinder is towed to rotate a rear portion of the support body about a pin as a pivot provided at a front end portion of the support body, so that one corner portion of a leading end portion of the fly is trimmed into an arcuate shape by a cutter and at the same time, the arcuately trimmed edge portion is serged by a needle. According to the apparatus, therefore, the one corner portion of the leading end of the fly can be trimmed into a uniform arcuate shape.

4 Claims, 6 Drawing Sheets

TROUSERS-FLY-SERGING APPARATUS

BACKGROUND OF THE INVENTION

1. Field of the Invention

The present invention relates to a trousersfly-serging apparatus and particularly to a rotary supply section for rotating a fly and trimming a corner portion of the fly into an arcuate shape and serging a longitudinal edge portion of the fly.

2. Description of the Related Art

As a rotary supply section in a conventional trousers-fly-serging apparatus, there are ones as disclosed in Japanese Patent Publication Laid-open No. 5-192471 and U.S. Pat. No. 5,161,474, for example. According to the apparatus of the Publications, a guide is formed continuously by bending a supply unit and a serging unit into a V shape so as to supply a fly to the serging unit from a diagonally rear direction, the fly is guided to abut on an angle of the guide, which projects toward a supply passage, and then the fly is fed forward for serging and rotated by towing a leading end portion of the fly, and a corner portion of the leading end portion of the fly is trimmed into an arcuate shape and at the same time, is serged. There is also a known rotary supply section as disclosed in Japanese Patent Publication Laid-open No. 5-137865 wherein a spherical cloth-pressing member is disposed at a position near a serging unit. The cloth-pressing member is moved down to press a portion of a supplied fly near a leading end portion and near a center on one side of the fly, and the leading end portion of the fly is towed by a pulling force by feeding of feed dogs actuated together with a needle to rotate the fly about a portion pressed by the spherical pressing member as a pivot, so that one corner portion of the leading end portion of the fly is trimmed into an arcuate shape, and at the same time, is serged.

In any of the conventional rotary supply sections, the fly is rotated by pulling the leading end portion of the fly by a pulling force of feeding of the feed dogs of the serging unit, and a pivot about which the fly rotates is a projecting angle of the guide or a point pressed by a spherical pressing member. Therefore, the towing force of the fly is liable to vary and the pivot about which the fly rotates is liable to be displaced.

As a result, the shape of the corner portion of the fly as trimmed varies, so that the uniform flies can not be necessarily obtained but irregular products are produced.

SUMMARY OF THE INVENTION

Therefore, it is an object of the present invention to provide a trousers-fly-serging apparatus in which the conventional problems are solved, one corner portion of a leading end portion of a fly can be constantly trimmed into a uniform arcuate shape, and a side end portion of the fly including the arcuate edge portion can be serged neatly.

To achieve the above object, according to the present invention, there is provided a trousers-fly-serging apparatus for supplying a trousers fly to a serging unit from a diagonally upstream direction and for rotating the supplied fly to trim one corner portion of a leading end portion of the fly into an arcuate shape, and at the same time, to serge the arcuate edge portion and one longitudinal edge portion of the fly, the apparatus comprising a supply portion of the fly including a linear supply section and a rotary supply section, wherein the rotary supply section includes a support body with a rear portion thereof being rotatable about a front end portion of the rotary supply section as a pivot, and several pressing levers are provided at a lower portion of the support body for upward and downward movements to press and retain the fly on a feed table, so that the fly fed from the linear supply section is received, and the rear portion of the support body is rotated to trim the one corner portion of the leading end portion of the fly into the arcuate shape and at the same time, to serge the arcuate edge portion and the one longitudinal edge portion of the fly.

Preferably, the support body of the rotary supply section is hung by a pin, which is rotatably supported by a support portion fixed to a proper position of the serging apparatus, is attached to the front end portion of the support body, and which functions as a rotation pivot. With this structure, a space for pressing and retaining the fly can be formed below the support body so that the fly can be easily disposed with the leading end portion thereof in contact with the serging unit.

Further preferably, the support body of the rotary supply section has, at a center of a rear portion thereof, a notch portion into which a retaining portion of the linear supply section for feeding the fly enters and fits. With this structure, four corners of the fly can be easily pressed and retained, and the pressed and retained fly can be positioned such that the leading end portion of the fly is constantly and accurately in contact with the serging unit.

Still further, it is preferable that each of the several pressing levers attached to the lower portion of the support body of the rotary supply section has, at a lower end thereof, a rotary roll rotatable only in a longitudinal direction of the fly. With this structure, the pressed and retained fly can be fed smoothly.

Still further, it is preferable that the support body of the rotary supply section includes a guide side wall hung from a lower portion of a longitudinal side portion of the support body. With this structure, the pressed and retained fly can be rotated while being pushed from a rear direction, and the fly can be fed accurately while being guided by the guide side wall.

DESCRIPTION OF THE PREFERRED EMBODIMENTS

Figure 1:
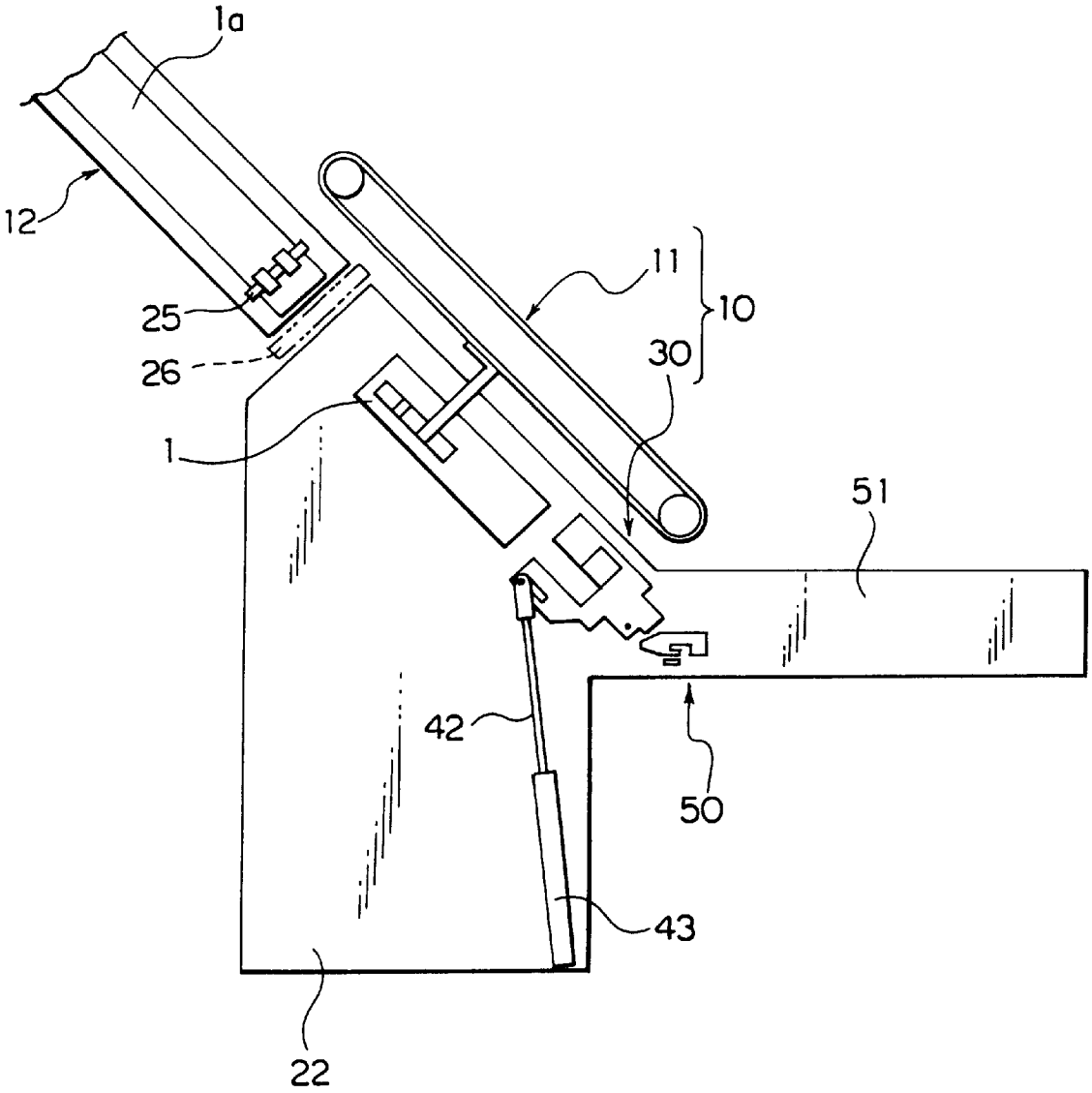
FIG. 1 is a schematic plan view of an entire serging apparatus of the present invention.

Embodiments of the present invention will be now described below based on examples shown in the drawings.

Figure 2:
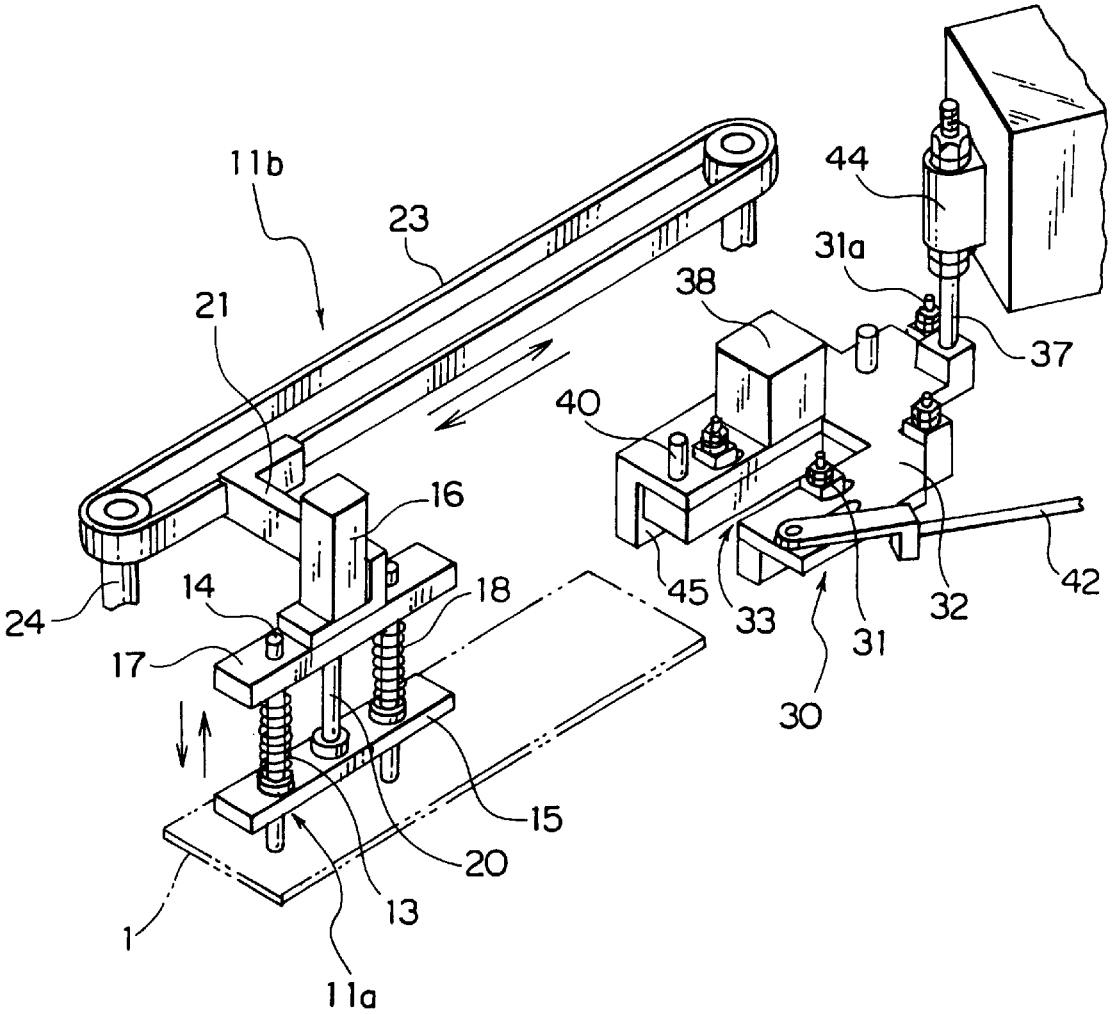
FIG. 2 is a perspective view of a linear supply section and a rotary supply section.
Figure 4:
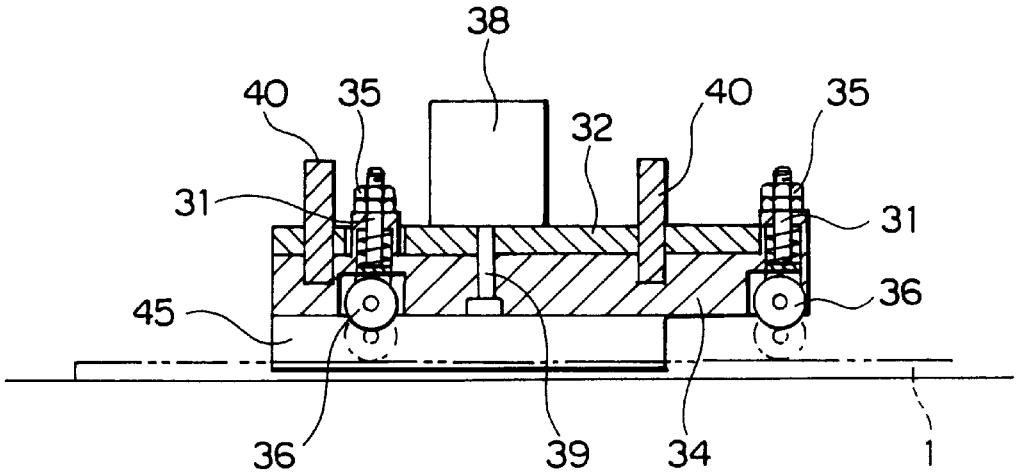
FIG. 4 is a sectional view of a structure of the rotary supply section.
Figure 5:
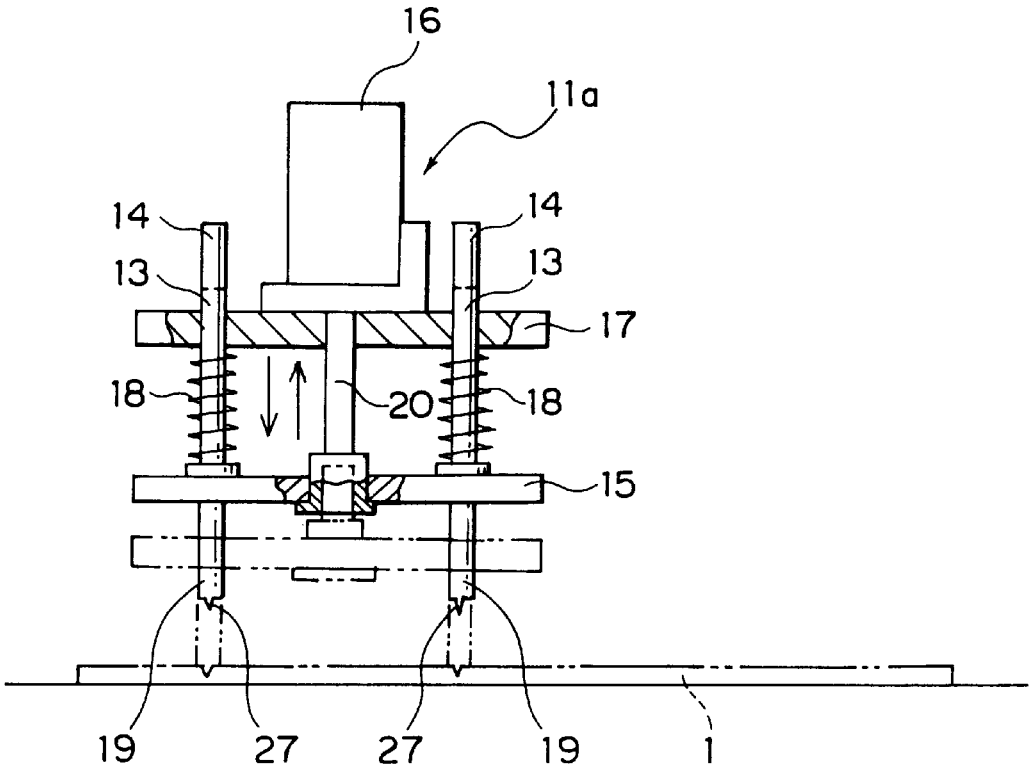
FIG. 5 is a sectional view of a structure of the linear supply section.
Figure 9:
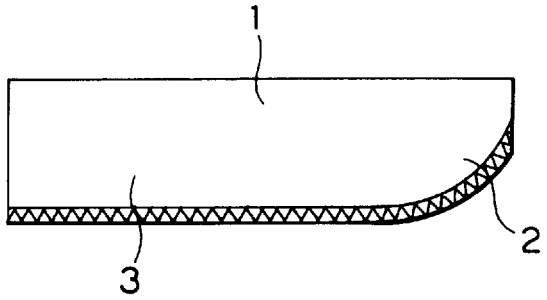
FIG. 9 is a plan view of a processed fly product.
Figure 10:
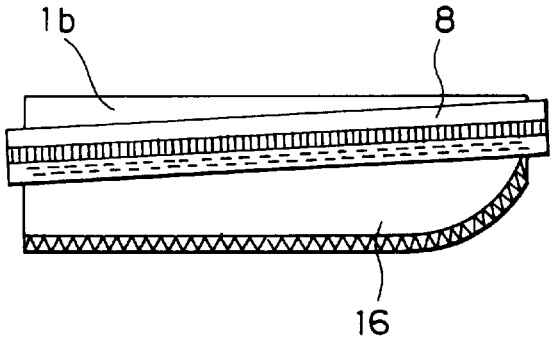
FIG. 10 is a plan view of another processed fly product.

FIG. 1 schematically shows an entire trousers-fly-serging apparatus. FIGS. 2, 4, and 5 show respective structures of a supply unit for flies. FIGS. 9 and 10 show flies processed by the present apparatus.

As shown in FIG. 1, the trousers-fly-serging apparatus comprises a supply unit 10 and a serging unit 50 for the fly 1, supplies the fly 1 to the serging unit 50 from a diagonally rear direction, trims one corner portion 2 of a leading end portion of the fly 1 into an arcuate shape, and serges a longitudinal edge portion 3 of the fly 1 including the arcuate edge by using a sewing machine to avoid raveling of cloth of the fly 1 and to make the fly 1 good in appearance.

The supply unit 10 for the fly 1 comprises a linear supply section 11 and a rotary supply section 30 and is diagonally connected to the serging unit 50 as shown in FIG. 1. The linear supply section 11 receives the fly 1 supplied from a supply device 12 connected to the serging apparatus, supplies the fly 1 to the next rotary supply section 30. The linear supply section 11 comprises a retaining portion 11*a* and a carriage portion 11*b* for reciprocating the retaining portion 11*a*. As shown in FIGS. 2 and 5, the retaining portion 11*a* comprises pressing levers 13 and a pressure cylinder 16 for actuating the pressing levers 13. At least two front and rear pressing levers 13 are attached to an attaching frame 15 and head portions 14 of the pressing levers 13 are loosely received by a support plate 17. A compression spring 18 is fitted around an intermediate portion of each of the pressing levers 13 between the attaching frame 15 and the support plate 17 and normally pushes the pressing lever 13 downward. The pressure cylinder 16 is attached to the support plate 17 and a rod 20 of the pressure cylinder 16 is connected to the attaching frame 15 and moves up and down by pressure. Thus, the fly 1 formed by cutting a continuous fly into a constant length and supplied from the supply device 12 is retained from above by the two pressing levers 13 and is released. A hanging arm 21 is attached to a side of the support plate 17 to which the pressure cylinder 16 is attached for actuating the attaching frame 15 and is hung on an endless belt 23 provided on one side of a feed table 22. The carriage portion 11*b* comprises the endless belt 23 and a driving shaft 24 for actuating the endless belt 23. The endless belt 23 bridges a pair of rotary shafts along a side of the feed table 22. One of the rotary shafts is the driving shaft 24 and the endless belt 23 is rotated in normal and reverse directions by rotation of the driving shaft 24 so as to feed or move the linear supply section 11 toward or away from the next rotary supply section 30. A long fly 1*a* supplied to the supply device 12 connected to a rear portion of the present apparatus is fed off by a supply roller 25 and cut into a predetermined length by a cutting blade 26 to be a single fly piece 1 and fed onto the feed table 22. Then, the pressing levers 13 standing by at predetermined positions above the fly 1 move down by actuation of the pressure cylinder 16 to press a surface of the fly 1 and to retain the fly 1 between the pressing levers 13 and a surface of the feed table 22, as shown by dashed lines in FIG. 5. The fly 1 is pierced by projections 27 provided to lower portions 19 of the respective pressing levers 13 so that it can be reliably fed on the feed table 22. The endless belt 23 is rotated to feed the fly 1 to the downstream rotary supply section 30 in a state wherein the pressing levers 13 have moved down to press and retain the fly 1. When feeding of the fly 1 has been completed and the fly 1 has been pressed and retained by the rotary supply section 30 which will be described later, the pressure cylinder 16 on the support plate 17 is actuated to pull the rod 20 upward and moves the two pressing levers 13 attached to the attaching frame 15 up to positions as shown by solid lines in FIG. 5, thereby releasing the fly 1. Thereafter, the endless belt 23 is rotated in a reverse direction to return the retaining portion 11*a* of the linear supply section 11 to the initial position and to bring the retaining portion 11*a* into a standby position for feeding of the succeeding fly 1. By repeating such operations, the fly 1 is fed to the next rotary supply section 30.

Figure 3:
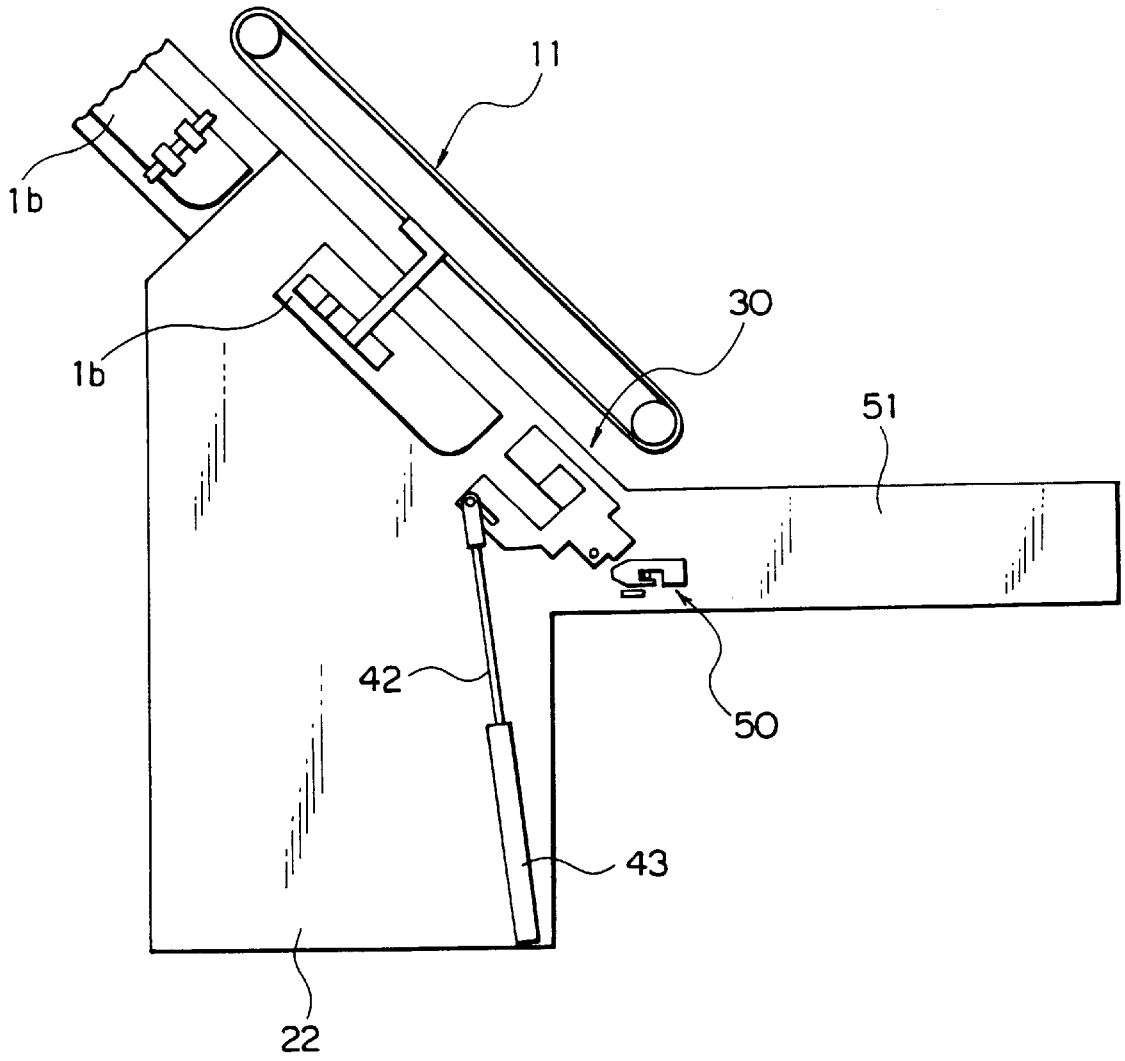
FIG. 3 is a schematic plan view of an entire serging apparatus for supplying and processing a single fly piece.

The long fly 1*a* is fed by the supply roller 25 by a predetermined length to be cut by the cutting blade 26 to be a single fly piece 1, which is supplied to the linear supply section 11 in the embodiment shown in FIG. 1. When a slide fastener chain 8 is sewn on the long fly 1*a*, space portions of the slide fastener chain 8, which are provided at constant intervals and where engaging elements are not attached, are detected, and the fly 1*a* is cut at the space portions to be single fly pieces 1 and fed to the linear supply section 11. Further, in a case of a fly 1*b* to which a slide fastener chain 4 is diagonally sewn and when the fly is not only a long fly but is a cut fly piece with a predetermined length, the single fly piece 1*b* is supplied one by one to the linear supply section 11 as shown in FIG. 3.

The rotary supply section 30 is arranged on an extension of the linear supply section 11 at a downstream side thereof. The rotary supply section 30 receives the fly 1 fed by the retaining portion 11*a* of the linear supply section 11, and reliably presses and retains the fly 1. Then, a rear portion of the rotary supply section 30 is towed to rotate the fly 1 together with the rotary supply section 30 about a front end portion of the rotary supply section 30 as a pivot. As a result, one corner portion 2 of a leading end portion of the fly 1 is trimmed by a cutter 4 into a constant arcuate shape, and at the same time, the corner edge portion of the fly 1 is serged by a needle 5. While a longitudinal edge portion 3 of the fly 1 is serged , the fly 1 is retained by the rotary supply section 30, thereby constantly obtaining uniformly processed products.

Figure 6:
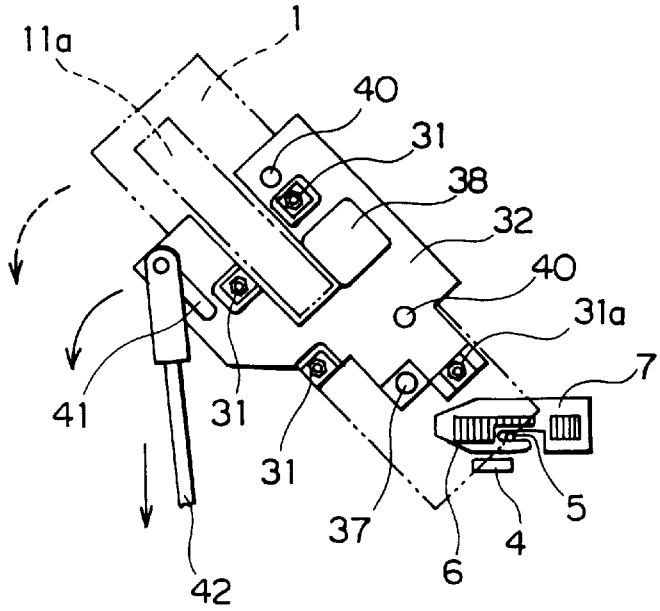
FIG. 6 is an explanatory view showing rotation of a support body of the rotary supply section in sequence and showing a state wherein the support body recieves the fly and starts rotating.
Figure 7:
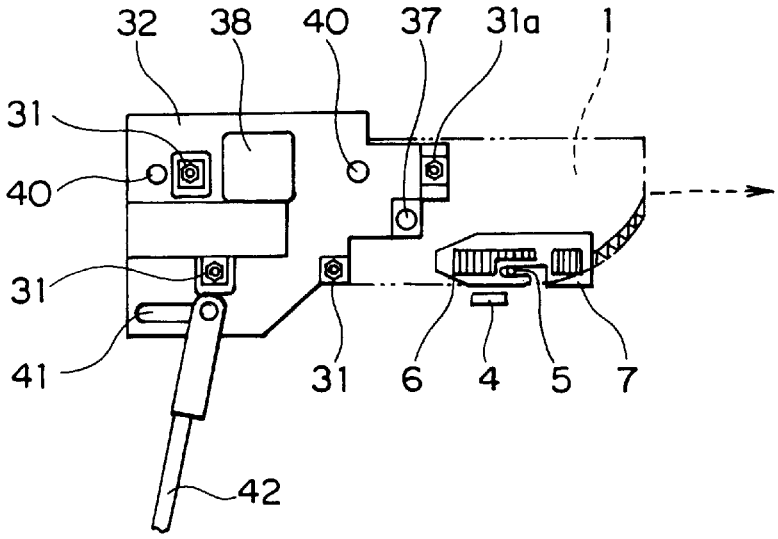
FIG. 7 is an explanatory view similar to FIG. 7 but showing a state of serging of a longitudinal edge portion of the fly as the support body further rotates.
Figure 8:
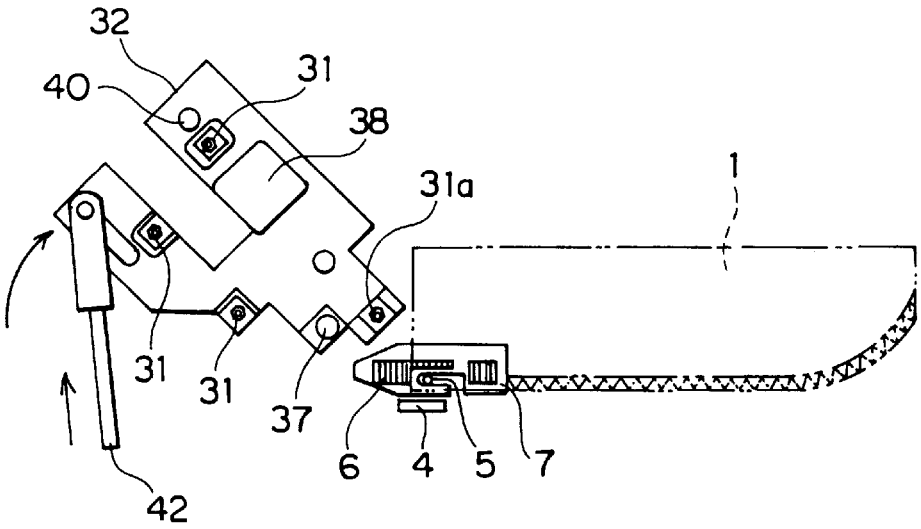
FIG. 8 is an explanatory view similar to FIGS. 6 and 7 but showing a state wherein the support body has returned to its original position after the processing of the fly is finished.

FIGS. 2 and 4 show a structure of the rotary supply section 30. A support body 32, at a lower face of which pressing levers 31 are attached for pressing and retaining the fly 1, has a pin 37 at its front end portion as shown in FIG. 2. The support body 32 is hung by the pin 37 of which upper portion is rotatably inserted in and supported by a support portion 44 fixed to a proper position (not shown) of the serging apparatus. Thus, a space is formed below the support body 32 such that the supplied fly 1 can be disposed, pressed, and retained with the leading end portion of the fly 1 in contact with the serging unit 50. Further, a notch portion 33 is formed at a center of a rear portion of the support body 32 so that the attaching frame 15 of the pressing levers 13 of the retaining portion 11*a* of the linear supply section 11 for feeding the fly 1 can enter and fit into the notch portion 33 from a rear direction as shown by dashed lines in FIG. 6. As a result, the rotary supply section 30 can press and retain the fly 1 in a wide range including the front and rear portions of the fly 1 and can position the fly 1 such that the leading end portion of the fly 1 is always positioned at a position of the needle 5 of the serging unit 50. At positions corresponding to four corners of the support body 32, four pressing levers 31 for pressing and retaining the fly 1 are disposed on a lower face of the support body 32, respectively. The four pressing levers 31 are attached to a single attaching frame 34, and the fly 1 on the feed table 22 is pressed and released by moving up and down the attaching frame 34. The pressing levers 31 are loosely received by the support body 32, and their adjusting nuts 35 are respectively fitted on head portions of the pressing levers 31 so as to adjust lengths of the pressing levers 31 projecting downward. Rotary rolls 36 are respectively attached to lower ends of the pressing levers 31 so as to rotatably press and retain the fly 1 by lowering of the pressing levers 31 and to move the fly 1 only in a longitudinal direction of the fly 1, as shown by dashed lines in FIG. 4. One of the pressing levers 31*a* at the front end portion of the support body 32 is disposed forward of the pin 37 as a pivot of rotation of the support body 32 which will be described later and presses the leading end portion of the fly 1 at the forward position so as to prevent displacement of the leading end portion of the fly 1 due to the rotation. A pressure cylinder 38 for moving up and down the attaching frame 34 of the pressing levers 31 is attached to a center of a side portion of the support body 32 and actuates the attaching frame 34 upward and downward by a rod 39. Further, two guide pins 40 attached to the attaching frame 34 are loosely received in the support body 32, and head portions of the guide pins 40 are projecting upward. As shown in FIG. 6, an elongated hole 41 extending in the longitudinal direction is defined at a side portion of a rear end of the support body 32, and a tip end of a rod 42 for rotating the support body 32 is loosely received in the elongated hole 41. This rod 42 is towed and extended by actuation of a pressure cylinder 43 rotatably attached to a rear end portion of the rod 42 at a side end of the feed table 22 as shown in FIG. 1. By the tow and extension of the rod 42, the support body 32 rotates about the pin 37 attached to the front end portion of the support body 32 as a pivot, from a receiving position of the fly 1 shown in FIG. 6 to a position for serging a longitudinal edge portion 3 of the fly 1 shown in FIG. 7, during which time the rear end portion of the support body 32 rotates so as to rotate the leading end portion of the fly 1 and to trim the one corner portion 2 of the fly 1 into an arcuate shape, and at the same time to serge the corner portion 2. Then, after feeding off the fly 1, the rear portion of the support body 32 rotates back for receiving and processing the succeeding fly 1 as shown in FIG. 8. A side wall 45, which extends down to reach a position close to the surface of the feed table 22, is provided at a side portion of the support body 32 as shown in FIGS. 2 and 4, retains and pushes the fly 1 sideways in rotation of the support body 32, and also regulates and guides a side of the fly 1 which is fed in serging of the longitudinal edge portion 3 of the fly 1 as shown in FIG. 7 so as to neatly carry out the serging.

The pin 37 is fastened at its positions above and below the support portion 44 by nuts as shown in FIG. 2 so that a position of the pin 37 is adjustable in a vertical direction. As a result, it is possible to adjust the position of the support body 32 such that a lower end face of the side wall 45 which is hung from the support body 32 keeps a distance equal to or smaller than a thickness of the fly 1 from an upper face of the feed table 22, which does not hinder rotation of the rotary supply section 30.

The serging unit 50 has a structure similar to a conventional serging machine, and carries out serging by the needle 5 which moves up and down while pressing the fly 1 with a presser foot 7, and feeds off the fly 1 by feed dogs 6 for every stitch at the same time. The serging unit 50 is displaced from the pin 37 which is the pivot about which the rotary supply section 30 rotates, as shown in FIG. 7, so as to serge an edge portion of the fly 1 from a center of its leading end portion to its one longitudinal edge portion 3. A cutter 4 is provided on a side of the presser foot 7 so as to trim the edge portion of the fly 1 to be serged synchronously with the movement of the needle 5. After trimming and at the same time serging of the edge portion of the leading end portion of the fly 1 in the serging unit 50, the fly 1 is fed off to a discharge table 51 as a product as shown in FIG. 9 or 10.

FIG. 6 shows a state wherein the fly 1 has been supplied from the linear supply section 11 to the rotary supply section 30, its leading end portion of the fly 1 is positioned so as to face the needle 5 of the serging unit 50, and the serging starts simultaneously with the trimming. The rear portion of the rotary supply section 30 rotates about the pin 37 as the pivot by the tow of the rod 42. As the rear portion of the rotary supply section 30 rotates, the fly 1 is rotated and the one corner portion 2 of the leading end portion of the fly 1 rotates arcuately to pass on the cutter 4, thereby trimming the corner portion 2 into the arcuate shape. Then, the trimmed edge portion is serged by the needle 5. The rotary supply section 30 rotates to a position where the rotary supply section 30 is arranged in line with the serging unit 50 and stops there as shown in FIG. 7. Then, the longitudinal edge portion 3 of the fly 1 is serged by the needle 5 successively after serging of the corner portion 2 and at the same time, the fly 1 is fed off by the feed dogs 6 one after another onto the discharge table 51 as the sergedfly 1, 1*b* as shown in FIG. 9 or 10. Then, the rotary supply section 30 rotates in a reverse direction by extension of the rod 42 and returns to its original position and stand by for receiving the succeeding fly 1. By repeating such operations, the flies 1 are processed and finished in sequence.

According to the present apparatus, it is possible to process, for example, a long fly 1*a* to which a long slide fastener chain is sewn longitudinally, or a single fly piece 1 formed by cutting a long fly, to which the slide fastener chain is not sewn, into a predetermined length, or a fly 1*b* formed by diagonally sewing a slide fastener chain 8 with a predetermined length to a long fly and cutting the long fly into a predetermined length as shown in FIG. 10. It is also possible to similarly process a single fly piece having a corner portion which is trimmed slightly into an arcuate shape in advance by an amount smaller than the predetermined trimming amount as shown in FIG. 3 so that front and back face sides of the fly or a supply direction of the fly can be distinguished.

According to the present apparatus, the four corners of the fly 1 are pressed and retained by the rotary supply section 30, and then the fly 1 is rotated by rotating the rotary supply section 30 which is pressing and retaining the fly 1 about the pivot which can not be displaced, and the one corner portion 2 of the leading end portion of the fly 1 is trimmed into an arcuate shape and at the same time, the fly 1 is serged. As a result, the fly 1 is retained and rotated in a constant state. Further, because the pivot of the rotation is not displaced, the trimmed shape of the one corner portion 2 of the leading end portion of the fly 1 is made in a constant arcuate shape. Thus, after the edge portion is serged, the uniform products can be obtained.

According to the present invention which has the above-described structures, the fly 1 fed from the linear supply section 11 is pressed and retained by several pressing levers 31 attached to the support body 32 of the rotary supply section 30, and the fly 1 is rotated by rotating the rear portion of the support body 32 about the front end portion of the support body 32 as a pivot to trim the one corner portion 2 of the leading end portion of the fly 1 into an arcuate shape, and at the same time, to serge the one longitudinal edge portion of the fly including the corner edge portion 2. Therefore, because the fly 1 is rotated and supplied to the serging unit 50 in a constant state, it is possible to constantly trim the one corner portion 2 of the leading end portion of the fly 1 into a constant arcuate shape, thus the uniform products can be obtained after the edge portion is serged.

Further, the support body 32 of the rotary supply section 30 is hung by attaching the pin 37 to the front end portion of the support body 32 and rotatably supporting the pin 37 by the support portion 44 fixed to a proper position of the serging apparatus. Therefore, a space can be formed below the support body 32 so that the fly 1 can be easily disposed such that the leading end portion of the fly 1 is in contact with the needle 5, the cutter 4, and the other members of the serging unit 50.

Furthermore, the support body 32 of the rotary supply section 30 has, at the center of the rear portion thereof, the notch portion 33 into which the attaching frame 15 of the pressing levers 13 of the linear supply section 11 enters and fits. Because the four corners of the fed fly 1 can be pressed and retained, the fly 1 can be further reliably retained, and the fly 1 is not displaced even when the fly 1 is rotated so that the fly 1 can be supplied to the serging unit 50 in a constant state. Moreover, because the retaining portion 11*a* of the linear supply section 11, which has fed the fly 1 while retaining it, can be stopped at a constant position by the notch portion 33 to pass the fly 1 to the serging unit 50, the fly 1 can be positioned at a constant position with respect to the serging unit 50.

Still further, the several pressing levers 31 attached to the lower portion of the support body 32 of the rotary supply section 30 has, at lower ends thereof, the rotary rolls 36 rotatable only in the longitudinal direction of the fly 1. Therefore, the fly 1 can be smoothly fed off from the support body 32 in serging of the one longitudinal edge portion 3 of the fly 1, so that uniform stitches of the serging can be obtained.

Still further, the support body 32 of the rotary supply section 30 includes the guide side wall 45 provided at the lower portion of one longitudinal side portion of the support body 32. Therefore, the fly 1 is rotated while being pushed at its longitudinal edge portion sideways, the fly 1 can be further reliably rotated and fed, so that the constant trimming of the corner portion 2 of the fly 1 into a constant arcuate shape can be ensured. Moreover, because the guide side wall 45 guides the longitudinal edge portion of the fly 1 during serging of the other longitudinal edge portion 3 of the fly 1 to feed off the fly 1 straightly, the lontigudinal edge portion 3 of the fly 1 can be serged neaatly.

What is claimed:

1. A trousers-fly-serging apparatus for supplying a trousers fly to a serging unit from a diagonally upstream direction and for rotating the supplied fly to trim one comer portion of a leading end portion of the fly into an arcuate shape, and at the same time, to serge the arcuate edge portion and one longitudinal edge portion of the fly, the apparatus comprising a supply portion of the fly including a linear supply section and a rotary supply section, wherein the rotary supply section includes a support body with a rear portion thereof being rotatable about a front end portion of the rotary supply section as a pivot, and wherein the support body of the rotary supply section has, at a center of a rear portion thereof, a notch portion into which a retaining portion of the linear supply section for feeding the fly enters and fits, and several pressing levers are provided at a lower portion of the support body for upward and downward movements to press and retain the fly on a feed table, so that the fly fed from the linear supply section is received, and the rear portion of the support body is rotated to trim the one comer portion of the leading end portion of the fly into the arcuate shape and at the same time, to serge the arcuate edge portion and the one longitudinal edge portion of the fly.

2. A trousers-fly-serging apparatus for supplying a trousers fly to a serging unit from a diagonally upstream direction and for rotating the supplied fly to trim one comer portion of a leading end portion of the fly into an arcuate shape, and at the same time, to serge the arcuate edge portion and one longitudinal edge portion of the fly, the apparatus comprising a supply portion of the fly including a linear supply section and a rotary supply section, wherein the rotary supply section includes a support body with a rear portion thereof being rotatable about a front end portion of the rotary supply section as a pivot, and several pressing levers are provided at a lower portion of the support body for upward and downward movements to press and retain the fly on a feed table, so that the fly fed from the linear supply section is received, and wherein each of the several pressing levers attached to the lower portion of the support body of the rotary supply section has, at a lower end thereof, a rotary roll rotatable only in a longitudinal direction of the fly, and the rear portion of the support body is rotated to trim the one comer portion of the leading end portion of the fly into the arcuate shape and at the same time, to serge the arcuate edge portion and the one longitudinal edge portion of the fly.

3. A trousers-fly-serging apparatus according to claim 1 or 2, wherein the support body of the rotary supply section is hung by a pin, the pin being rotatably supported by a support portion fixed to a certain position of the serging apparatus, being attached to the front end portion of the support body, and functioning as a rotation pivot.

4. A trousers-fly-serging apparatus according to claim 1 or 2, wherein the support body of the rotary supply section includes a guide side wall extended from a lower portion of a longitudinal side portion of the support body.

* * * * *